US009254893B2

(12) United States Patent
Phadke et al.

(10) Patent No.: US 9,254,893 B2
(45) Date of Patent: Feb. 9, 2016

(54) SUBSEA PLATFORM TRANSPORTER (SPT)

(71) Applicant: CONOCOPHILLIPS COMPANY, Houston, TX (US)

(72) Inventors: Amal C. Phadke, Houston, TX (US); George Z. Gu, Houston, TX (US); Scott E. Coblitz, Houston, TX (US); Daniel R. Givan, Houston, TX (US); Derrick Laskowski, Houston, TX (US); Chad A. Petrash, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 14/538,141

(22) Filed: Nov. 11, 2014

(65) Prior Publication Data

US 2015/0132066 A1 May 14, 2015

Related U.S. Application Data

(60) Provisional application No. 61/902,409, filed on Nov. 11, 2013.

(51) Int. Cl.

| | |
|---|---|
| ***B63B 35/00*** | (2006.01) |
| ***B63B 21/56*** | (2006.01) |
| ***B63B 9/06*** | (2006.01) |
| ***E21B 43/013*** | (2006.01) |
| ***B63G 8/22*** | (2006.01) |
| *B63C 7/12* | (2006.01) |

(52) U.S. Cl.

CPC ..... *B63B 35/003* (2013.01); *B63B 9/065* (2013.01); *B63G 8/22* (2013.01); *E21B 43/013* (2013.01); *B63B 21/56* (2013.01); *B63B 2009/067* (2013.01); *B63C 7/12* (2013.01)

(58) Field of Classification Search

CPC ..... E02B 17/021; E02B 2017/0039
USPC ..... 405/205, 207–210
See application file for complete search history.

(56) References Cited

U.S. PATENT DOCUMENTS

| | | | |
|---|---|---|---|
| 6,652,192 | B1 | 11/2003 | Xu et al. |
| 7,516,795 | B2 | 4/2009 | Lopes Euphemio et al. |
| 2002/0092455 | A1 | 7/2002 | Kellogg et al. |
| 2009/0114139 | A1 | 5/2009 | Zou |
| 2011/0100280 | A1 | 5/2011 | Leverette |
| 2012/0063850 | A1 | 3/2012 | Collins |
| 2012/0234117 | A1 | 9/2012 | Oswald |

FOREIGN PATENT DOCUMENTS

| | | |
|---|---|---|
| WO | 2014130320 | 8/2014 |

OTHER PUBLICATIONS

International Search Report Dated Feb. 24, 2015. PCT/US2014/065022.

*Primary Examiner* — Tara M. Pinnock
(74) *Attorney, Agent, or Firm* — ConocoPhillips Company

(57) ABSTRACT

A subsea platform transporter includes a plurality of pontoon members, a plurality of column members interconnecting select adjacent ones of the plurality of pontoon members forming a support frame having an inner platform receiving area, a plurality of buoyancy members mechanically linked to at least one of the plurality of pontoon members and the plurality of column members, and a plurality of platform retaining members mounted to one or more of the plurality of pontoon members and the plurality of column members about the inner platform receiving area. The plurality of platform retaining members is configured and disposed to selectively retain and release a platform supported by the subsea platform transporter.

18 Claims, 4 Drawing Sheets

SUBSEA PLATFORM TRANSPORTER (SPT)

CROSS-REFERENCE TO RELATED APPLICATIONS

This application is a non-provisional application which claims benefit under 35 USC §119(e) to U.S. Provisional Application Ser. No. 61/902,409 filed Nov. 11, 2013, entitled "SUBSEA PLATFORM TRANSPORTER (SPT)" which is incorporated herein in their entirety.

FIELD OF THE INVENTION

This invention relates to a subsea platform transporter. In another aspect, the invention concerns a subsea platform transporter having a subsea system mounted to a subsea platform. In another aspect, the invention concerns a system for transporting a fully integrated and onshore tested subsea system to a sea floor location. In another aspect, the invention concerns a system for transporting a subsea drilling rig to the sea floor.

BACKGROUND OF THE INVENTION

Offshore oil and natural gas platform systems rely upon above sea platforms that support drilling and/or processing equipment to extract resources from subsea wells. The above sea platforms are mounted through a system of supports that extend from the offshore platform to the sea floor. Often times the supports are adjustable to account for changing sea and/or weather conditions. The supports position the above platform above a surface of the sea and include drilling systems, transport systems, support systems, such as electrical power generation, and crew accommodation systems. In addition to above sea platforms, many offshore platform systems include subsea platforms that support various systems at or near the sea floor.

Subsea platforms include subsea systems that support the above sea platforms with extraction, storage, and transport of resources such as oil and natural gas. Sub-systems are transported to a particular site, submerged, integrated to form one or more subsea systems, and tested. Current technology limits that transport and positioning of each sub-system to about 500 metric tons (MT). Therefore, the installation of a subsea platform may be a lengthy process depending upon the size, weight, and number of sub-systems. More specifically, a subsea system may require multiple support ships to transport and position each sub-system as well as a lengthy construction and testing phase prior to being ready to support the above sea platform.

SUMMARY OF THE INVENTION

In one embodiment of the present invention, a subsea platform transporter includes a plurality of pontoon members, a plurality of column members interconnecting select adjacent ones of the plurality of pontoon members forming a support frame having an inner platform receiving area, one or more buoyancy members mechanically linked to at least one of the plurality of pontoon members and the plurality of column members, and one or more platform retaining members mounted to one or more of the plurality of pontoon members and the plurality of column members about the inner platform receiving area. The one or more platform retaining members is configured and disposed to selectively retain and release a subsea platform supported by the subsea platform transporter.

In another embodiment of the present invention, a subsea platform transporter system includes a subsea platform transporter having a plurality of pontoon members, a plurality of column members interconnecting select adjacent ones of the plurality of pontoon members forming a support frame having an inner platform receiving area, one or more buoyancy members mechanically linked to at least one of the plurality of pontoon members and the plurality of column members, and one or more platform retaining members mounted to one or more of the plurality of pontoon members and the plurality of column members about the inner platform receiving area. The subsea platform transporter system also includes a subsea platform including a fully integrated subsea system mounted within the inner platform receiving area through the plurality of platform retaining members.

In accordance with yet another embodiment of the present invention, a method of transporting and submerging a fully integrated and tested subsea system includes assembling a plurality of sub-systems on a platform to form a fully integrated subsea system on shore, testing the fully integrated subsea system on shore, towing the fully integrated subsea system across a body of water to a location above the sea floor, and depositing the fully integrated subsea system on the sea floor.

BRIEF DESCRIPTION OF THE DRAWINGS

The invention, together with further advantages thereof, may best be understood by reference to the following description taken in conjunction with the accompanying figures by way of example and not by way of limitation, in which.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope of the invention. For instance, features illustrated or described as part of one embodiment can be used on another embodiment to yield a still further embodiment. Thus, it is intended that the present invention cover such modifications and variations that come within the scope of the appended claims and their equivalents.

Figure 1:
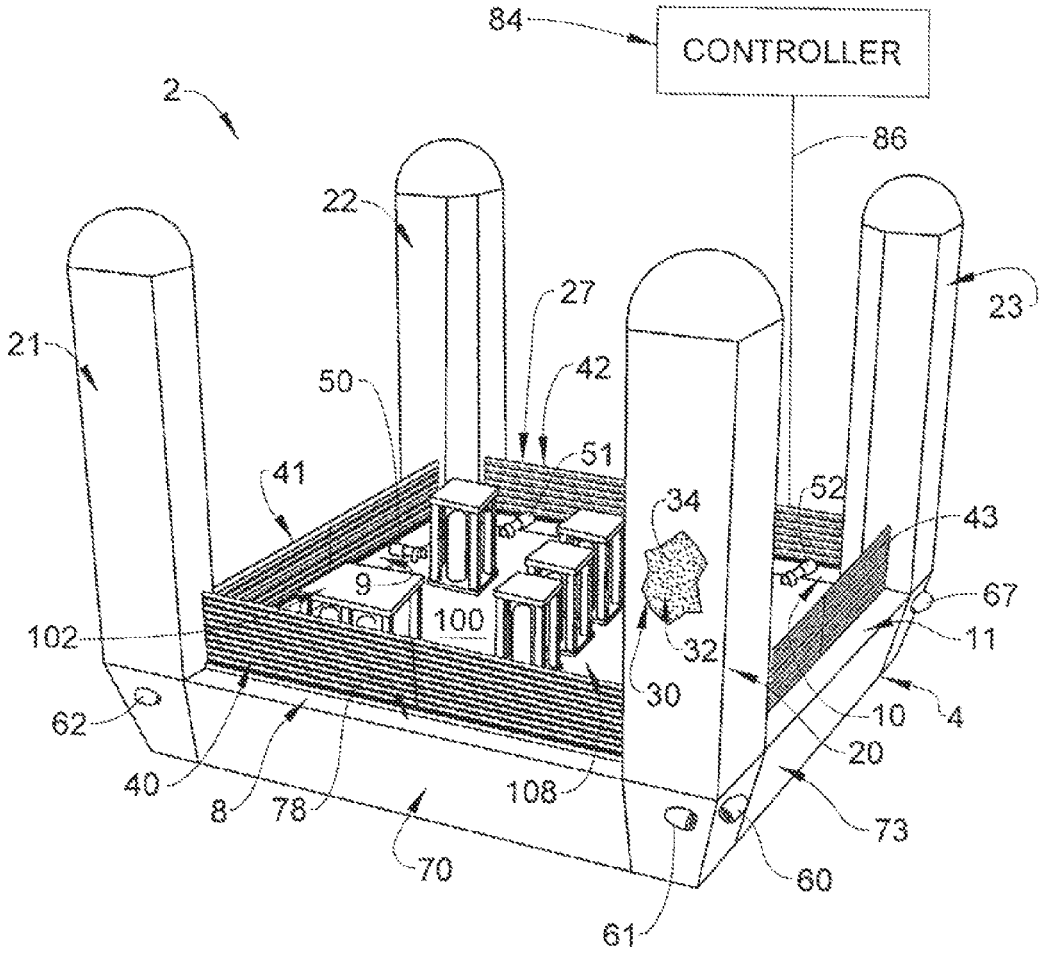
FIG. 1 depicts a perspective view of a subsea platform transporter system including a subsea platform transporter supporting a platform, in accordance with an exemplary embodiment.

A subsea platform transport system (SPTS), in accordance with an exemplary embodiment, is indicated generally at 2, in FIG. 1. SPTS 2 includes a subsea platform transporter (SPT) 4 including a first pontoon member 8, a second pontoon member 9, a third pontoon member 10, and a fourth pontoon member 11. Each pontoon member 8-11 includes one or more internal void spaces (not shown) filled with a ballast material (also not shown). The ballast material may take on a variety of forms including water, or high density materials such as various metals and alloys of metal. SPT 4 also includes a first column member 20, a second column member 21, a third column member 22, and a fourth column member 23. Of course it should be understood that the number of column members may vary. Column members 20-23 interconnect end portions (not separately labeled) of adjacent ones of pontoon members 8-11 to form an inner platform receiving area 27. Each column member 20-23 includes one or more internal cavities 30 that are filled with a buoyant material 32. Buoyant material 32 may take the form of hollow glass microspheres (34), thermosets, thermoplastics, light oils, foam concrete, low-density concrete or other materials that are buoyant in sea water. In this manner, column members 20-23 provide primary buoyancy for SPT 4, as will be discussed more fully below.

SPT 4 also includes a first plurality of buoyancy members 40 extending between first and second column members 20 and 21, a second plurality of buoyancy members 41 extending between second and third column members 21 and 22, a third plurality of buoyancy members 42 extending between third and fourth column members 22 and 23, and a fourth plurality of buoyancy members 43 extending between fourth and first column members 23 and 20. Each of the plurality of buoyancy members 40-43 includes one or more valves (not shown) that selectively control the ingress of sea water to adjust buoyancy of SPT 4. SPT 4 is further shown to include a plurality of platform retaining members, three of which are indicated at 50, 51 and 52 and which may take the form of hydraulic latches that extend about a periphery of inner platform receiving area 27. Platform retaining members may take on other forms including electrical latches, pneumatic latches and the like. Also, it should be understood that the particular arrangement and connection of buoyancy members 40, 41, 42, and 43 may vary.

In further accordance with the exemplary embodiment shown, SPT 4 includes a plurality of thrusters 60-67. Two of the plurality of thrusters 60-67 is mounted to respective ones of column members 20-23. Thrusters 60-67 are selectively activated to maneuver SPT 4 into a desired position, as will be detailed more fully below. SPT 4 further may include a first drag appendage 70 mounted to first pontoon member 8, a second drag appendage 71 mounted to second pontoon member 9, a third drag appendage 72 mounted to third pontoon member 10 and a fourth drag appendage 73 mounted to fourth pontoon member 11. Each drag appendage 70-73 includes an open upper end, such as shown at 78, with respect to first drag appendage 70. Drag appendages 70-73 may be stationary or selectively deployable to control ascent of SPT 4 from the sea floor to the sea surface. A controller 84 provides a support vessel based operator with functionality to control buoyancy members 40-43, platform retaining members 50-52, column members 20-23, and/or drag appendages 70-73. Controller 84 is coupled to SPT 4 through an umbilical cable 86.

In still further accordance with an exemplary embodiment, SPT 4 supports and delivers a subsea platform 100 to a desired location on the sea floor. Subsea platform 100 supports a plurality of undersea sub-systems 104 that are connected to form a fully integrated subsea system 108. The term "fully integrated" should be understood to mean that the system is in an operable condition needing only final connections to undersea components. The system is constructed and may be fully tested on shore, delivered to a desired location, and submerged as a functional system as will be detailed more fully below.

Figure 2:
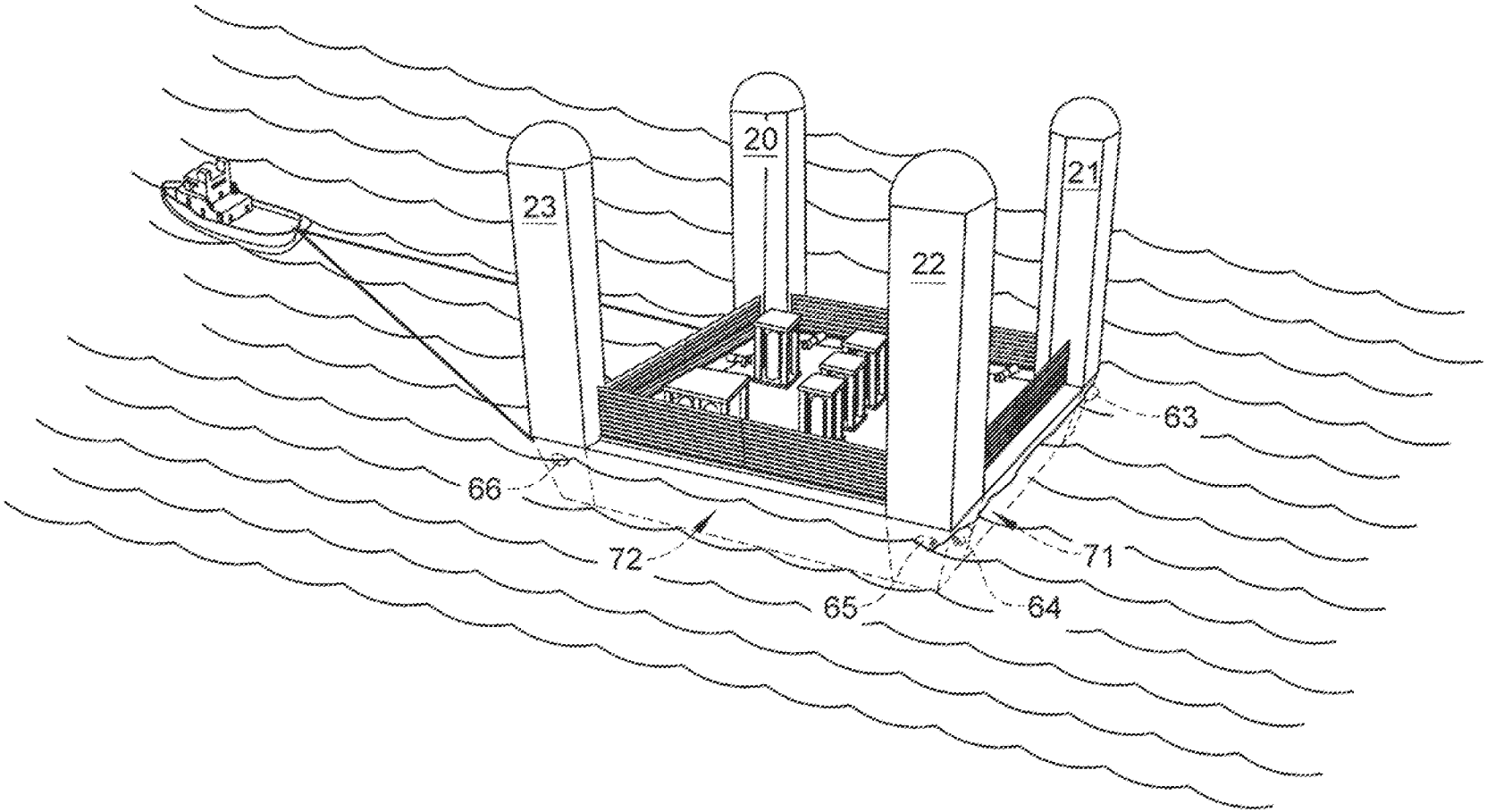
FIG. 2 depicts the subsea platform transporter system of FIG. 1 being towed across a body of water.
Figure 3:
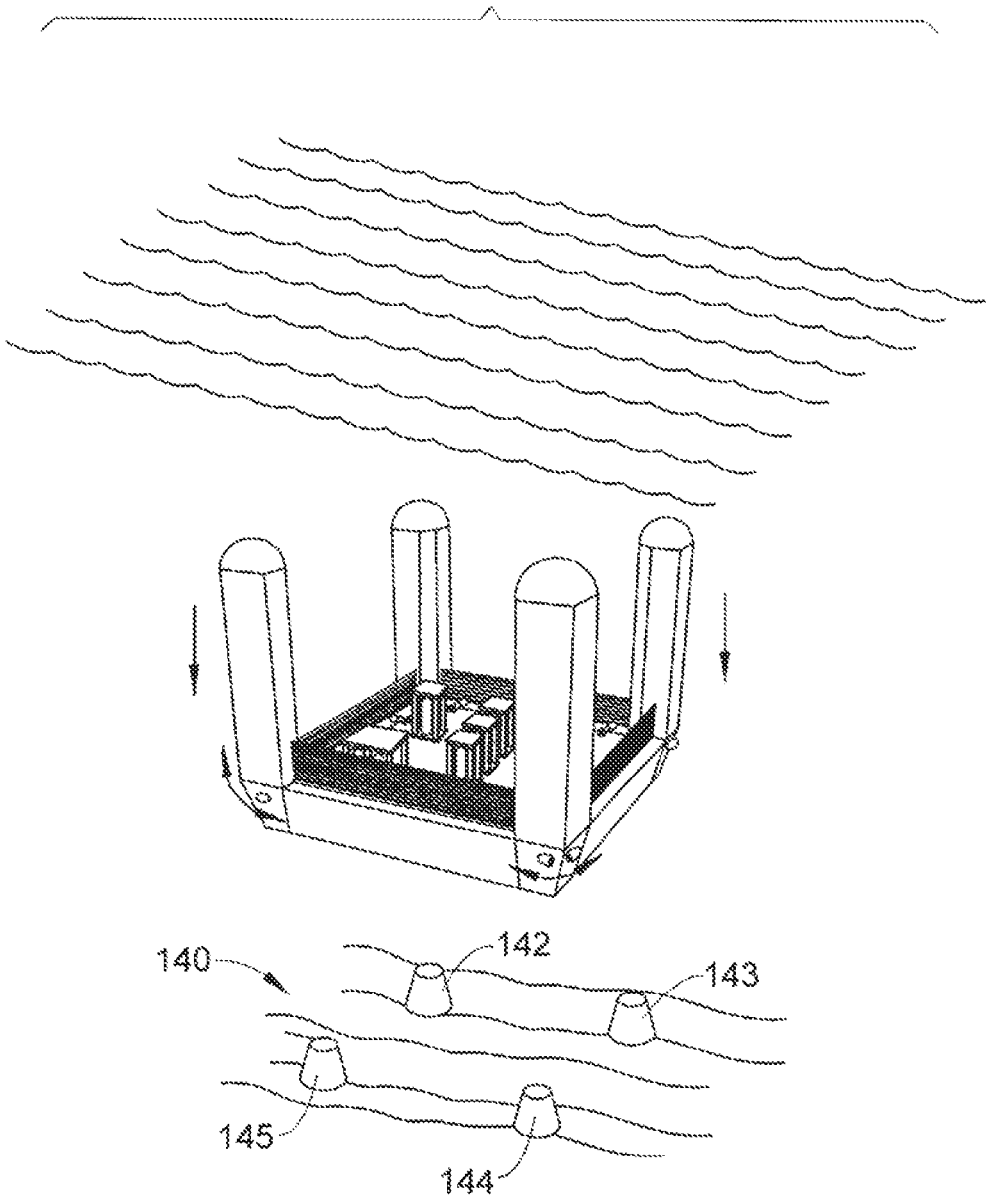
FIG. 3 depicts the subsea platform transporter system submerging toward a desired location on the sea floor.

After fully integrated subsea system 108 is assembled, and subsea platform 100 secured to SPT 4, subsea platform transporter system (SPTS) 2 is towed out to sea, as shown in FIG. 2. One or more support ships (not separately labeled) transport SPTS 2 to a desired position above the sea floor. Once in position, SPTS 2 submerges toward a support structure 140 having a plurality of support members 142-145. More specifically, buoyancy members 40-43 are selectively controlled to achieve a gradual descent of SPTS 2. Buoyancy members 40-43 are gradually filled with sea water to facilitate descent of SPTS 2. The rate of change of weight is controlled to account for changes in water density as depth increases. Once SPTS 2 nears support members 142-145, thrusters 60-67 are selectively activated to achieve a desired alignment between pins (not shown) extending from subsea platform 100 and support members 142-145. Once alignment is achieved, subsea platform 100 comes to rest upon support members 142-145.

Figure 4:
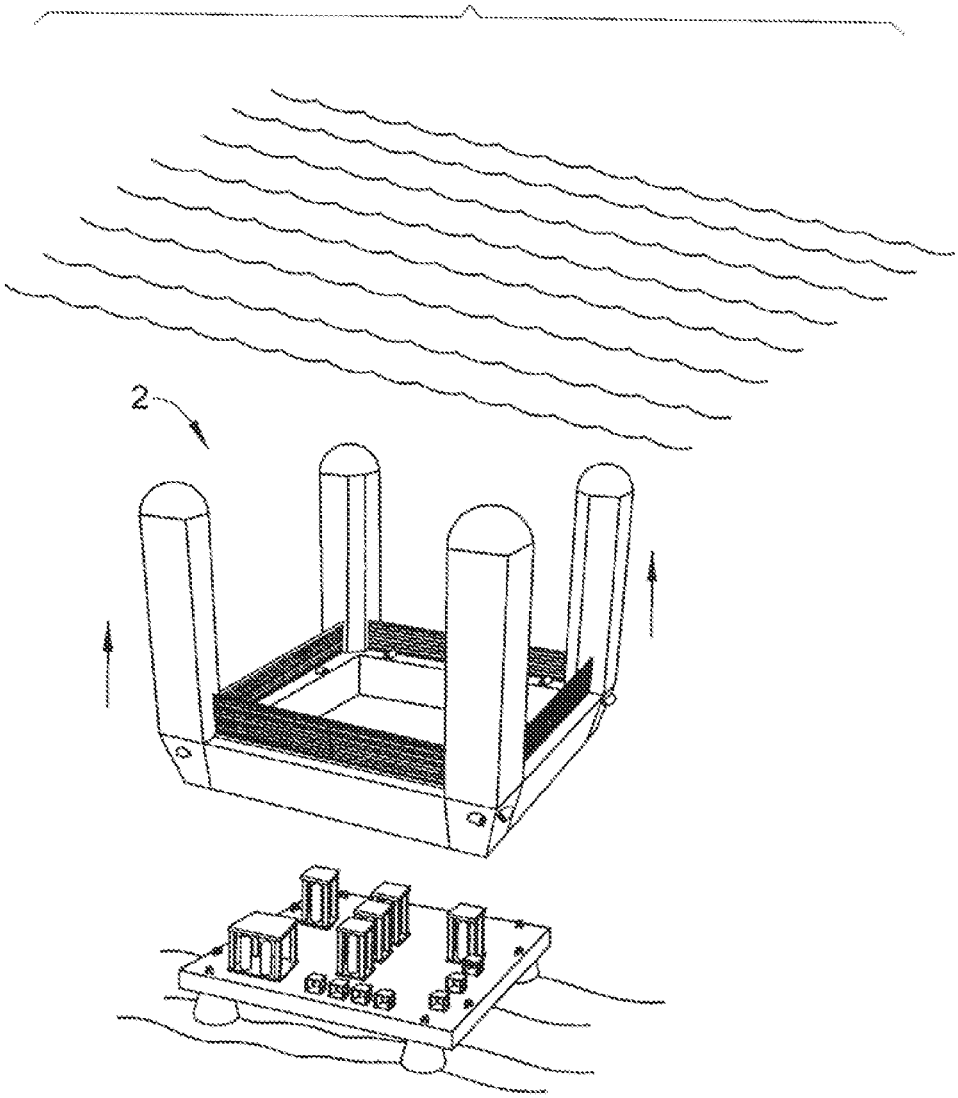
FIG. 4 depicts ascent of the subsea platform transporter following release of the platform.

After resting upon support members 142-145, platform retaining members 50-52 are released, or hydraulically unlatched, by a signal passing from controller 84. Once released, SPT 4 begins to ascend toward the sea surface, as shown in FIG. 4. Ascent of SPT 4 is controlled through drag appendages 70-73. More specifically, drag appendages 70-73 ensure that SPT 4 ascends at a desired rate. In accordance with one aspect of the exemplary embodiment, drag appendages 70-73 may be deployed at varying angles to control ascent. Once at the sea surface, the one or more support ships will tow SPT 4 back to dock. At this point it should be understood that SPTS 2 is capable of delivering a fully assembled subsea system to a location on the sea floor. SPTS 2 may deliver loads of up to 3,000 metric tons dry weight or more to depths of up to 10,000 feet of water or more. By using a weight controlled descent through selective control of buoyancy members and a drag controlled ascent through the use of drag appendages and/or additional flooding of buoyancy members prior to the release of the subsea platform, the SPTS may reduce overall costs, time, and assembly of undersea installations.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A subsea platform transporter comprising:

a plurality of pontoon members;

a plurality of column members interconnecting select adjacent ones of the plurality of pontoon members forming a support frame having an inner platform receiving area;

one or more buoyancy members mechanically linked to at least one the plurality of pontoon members and the plurality of column members; and one or more platform retaining members mounted relative to one or more of the plurality of pontoon members and the plurality of column members about the inner platform receiving area, the one or more platform retaining members being configured and disposed to selectively retain a subsea platform supported by the subsea platform transporter and release the subsea platform while supported on the sea floor, wherein the one or more platform retaining members comprise one of an electric latch and a hydraulic latch.

2. The subsea platform transporter according to claim 1, wherein each of the plurality of column members includes an internal cavity containing a buoyant material.

3. The subsea platform transporter according to claim 2, wherein the buoyant material comprises at least one of hollow glass microspheres, thermoplastic, thermoset, foam concrete, low-density concrete, and light oils.

4. The subsea platform transporter according to claim 1, further comprising: a controller operatively connected to the one or more buoyancy members, the controller being configured and disposed to selectively control the one or more buoyancy members to submerge the subsea platform transporter.

5. The subsea platform transporter according to claim 4, further comprising: at least one thruster operatively connected to the controller, at least one thruster being configured and disposed to maneuver the subsea platform transporter during descent.

6. The subsea platform transporter according to claim 1, further possibly comprising: one or more drag appendages configured and disposed to selectively control ascent of the subsea platform transport system.

7. The subsea platform transporter according to claim 6, wherein each of the plurality of pontoon members includes a corresponding drag appendage.

8. A subsea platform transport system comprising:

a subsea platform transporter including a plurality of pontoon members, a plurality of column members interconnecting select adjacent ones of the plurality of pontoon members forming a support frame having an inner platform receiving area, one or more buoyancy members mechanically linked to at least one of the plurality of pontoon members and the plurality of column members, and one or more platform retaining members mounted to one or more of the plurality of pontoon members and the plurality of column members about the inner platform receiving area;

a subsea platform including a fully integrated subsea system mounted within the inner platform receiving area through the plurality of platform retaining members; and a controller operatively connected to the one or more buoyancy members, the controller being configured and disposed to selectively control the one or more buoyancy members to submerge the subsea platform transporter.

9. The subsea platform transport system according to claim 8, wherein each of the plurality of column members includes an internal cavity containing a buoyant material.

10. The subsea platform transport system according to claim 9, wherein the buoyant material comprises hollow glass microspheres, thermoplastics, thermosets, foam concrete, low-density concrete, light oils, or other suitable material.

11. The subsea platform transport system according to claim 8, further comprising: at least one thruster operatively connected to the controller, the at least one thruster being configured and disposed to adjust an orientation of the subsea platform transporter during descent.

12. The subsea platform transport system according to claim 8, wherein the one or more platform retaining members comprise one of an electric latch and a hydraulic latch.

13. The subsea platform transport system according to claim 8, further comprising: one or more drag appendages configured and disposed to selectively control ascent of the subsea platform transport system.

14. The subsea platform transport system according to claim 13, wherein each of the plurality of pontoon members includes a corresponding drag appendage.

15. A method of transporting and submerging a fully integrated and tested subsea system, the method comprising:

assembling a plurality of sub-systems on a platform to form a fully integrated subsea system on shore;

testing the fully integrated subsea system on shore;

towing the fully integrated subsea system across a body of water to a location above the sea floor;

submerging a subsea system transporter coupled to the fully integrated subsea system;

depositing the fully integrated subsea system on the sea floor;

releasing the subsea system transporter from the fully integrated subsea system deposited on the sea floor; and returning the subsea system transporter to a semi-submerged state for towing.

16. The method of claim 15, wherein towing the fully integrated subsea system includes towing the subsea system transporter including a plurality of pontoon members interconnected by a plurality of column members.

17. The method of claim 16, wherein depositing the fully integrated subsea system includes unlatching the platform from the subsea platform transporter.

18. The method of claim 16, further comprising: controlling ascent of the subsea platform transporter through one or more drag appendages provided on one or more of the plurality of pontoon members.

* * * * *